US007927183B2

(12) United States Patent
Fukuda et al.

(10) Patent No.: US 7,927,183 B2
(45) Date of Patent: Apr. 19, 2011

(54) POLISHING PAD

(75) Inventors: Takeshi Fukuda, Osaka (JP); Junji Hirose, Osaka (JP); Yoshiyuki Nakai, Osaka (JP); Tsuyoshi Kimura, Osaka (JP)

(73) Assignee: Toyo Tire & Rubber Co., Ltd., Osaka (JP)

( * ) Notice: Subject to any disclaimer, the term of this patent is extended or adjusted under 35 U.S.C. 154(b) by 0 days.

(21) Appl. No.: 12/294,391

(22) PCT Filed: May 15, 2007

(86) PCT No.: PCT/JP2007/059970

§ 371 (c)(1),
(2), (4) Date: Sep. 24, 2008

(87) PCT Pub. No.: WO2007/132855

PCT Pub. Date: Nov. 22, 2007

(65) Prior Publication Data

US 2009/0137188 A1 May 28, 2009

(30) Foreign Application Priority Data

May 17, 2006 (JP) ..... 2006-137356

(51) Int. Cl.
*B24B 49/00* (2006.01)

(52) U.S. Cl. ..... 451/6; 451/41; 451/526; 451/527

(58) Field of Classification Search ..... 451/6, 41, 451/285, 287, 526, 527, 530, 533
See application file for complete search history.

(56) References Cited

U.S. PATENT DOCUMENTS

| | | | | |
|---|---|---|---|---|
| 5,436,399 | A | 7/1995 | Koyama et al. | |
| 5,605,760 | A | 2/1997 | Roberts | |
| 5,893,796 | A | 4/1999 | Birang et al. | |
| 6,832,947 | B2 * | 12/2004 | Manning | 451/41 |
| 6,855,034 | B2 * | 2/2005 | Hasegawa | 451/41 |
| 6,960,120 | B2 * | 11/2005 | Prasad | 451/41 |
| 6,984,163 | B2 * | 1/2006 | Roberts | 451/6 |
| 7,195,539 | B2 * | 3/2007 | Turner et al. | 451/6 |
| 7,226,339 | B2 * | 6/2007 | Benvegnu et al. | 451/6 |

(Continued)

FOREIGN PATENT DOCUMENTS

CN 1628138 6/2005

(Continued)

OTHER PUBLICATIONS

International Search Report mailed Jun. 12, 2007 directed towards international application No. PCT/JP2007/059970; 4 pages.

(Continued)

*Primary Examiner* — Eileen P. Morgan
(74) *Attorney, Agent, or Firm* — Morrison & Foerster LLP

(57) ABSTRACT

A polishing pad provides excellent optical detection accuracy properties over a broad wavelength range (particularly at the short-wavelength side). A method for manufacturing a semiconductor device includes a process of polishing the surface of a semiconductor wafer with this polishing pad. The polishing pad has a polishing layer containing a polishing region and a light-transmitting region, wherein the light-transmitting region includes a polyurethane resin having an aromatic ring density of 2 wt % or less, and the light transmittance of the light-transmitting region is 30% or more in the overall range of wavelengths of 300 to 400 nm.

5 Claims, 2 Drawing Sheets

U.S. PATENT DOCUMENTS

| | | | | |
|---|---|---|---|---|
| 7,238,097 | B2 * | 7/2007 | Ohno et al. | 451/527 |
| 7,306,507 | B2 * | 12/2007 | Benvegnu et al. | 451/6 |
| 7,435,165 | B2 * | 10/2008 | Prasad | 451/526 |
| 2003/0171081 | A1 * | 9/2003 | Komukai et al. | 451/285 |
| 2004/0157534 | A1 * | 8/2004 | Manning | 451/41 |
| 2004/0224611 | A1 * | 11/2004 | Aoi et al. | 451/6 |
| 2005/0176912 | A1 | 8/2005 | Shin et al. | |
| 2005/0248881 | A1 * | 11/2005 | Hayashida et al. | 360/131 |
| 2006/0037699 | A1 | 2/2006 | Nakamori et al. | |
| 2007/0190905 | A1 | 8/2007 | Shimomura et al. | |
| 2008/0008971 | A1 | 1/2008 | Shiba et al. | |

FOREIGN PATENT DOCUMENTS

| | | |
|---|---|---|
| EP | 0824995 | 2/1998 |
| JP | 6-206965 | 7/1994 |
| JP | 9-7985 | 1/1997 |
| JP | 10-83977 | 3/1998 |
| JP | 11-512977 | 11/1999 |
| JP | 2003-48151 | 2/2003 |
| JP | 3582790 | 8/2004 |
| JP | 2004-259728 | 9/2004 |
| JP | 2004-297061 | 10/2004 |
| JP | 2005-1059 | 1/2005 |
| JP | 2005-322790 | 11/2005 |
| JP | 2006-45523 | 2/2006 |
| JP | 2006-102940 | 4/2006 |
| WO | WO-2004/049417 | 6/2004 |
| WO | WO-2006/001518 | 1/2006 |

OTHER PUBLICATIONS

Taiwanese Office Action and Search Report received Dec. 18, 2009, directed to counterpart Taiwanese Application No. 096117368; 9 pages.

Chinese Office Action mailed Jan. 22, 2010, directed to counterpart Chinese Application No. 2007800179946; 9 pages.

Chinese Office Action dated Aug. 11, 2010 directed towards counterpart application No. 200780017994.6; 6 pages.

Korean Office Action mailed Sep. 1, 2010, directed to KR-10-2008-7020466; 5 pages.

* cited by examiner

POLISHING PAD

REFERENCE TO RELATED APPLICATIONS

This application is a national stage application under 35 USC 371 of International Application No. PCT/JP2007/059970, filed May 15, 2007, which claims the priority of Japanese Patent Application No. 2006-137356, filed May 17, 2006, the contents of both of which prior applications are incorporated herein by reference.

FIELD OF THE INVENTION

The present invention relates to a method for manufacturing a polishing pad by which the planarizing processing of optical materials such as lenses, reflecting mirrors and the like, silicon wafers, glass substrates for hard disks, aluminum substrates, and materials requiring a high degree of surface planarity such as those in general metal polishing processing can be carried out stably with high polishing efficiency. The polishing pad obtained by the manufacturing method of the present invention is used particularly preferably in a process of planarizing a silicone wafer, and a device having an oxide layer, a metal layer or the like formed on a silicon wafer, before lamination and formation of the oxide layer, the metal layer or the like.

BACKGROUND OF THE INVENTION

Production of a semiconductor device involves a step of forming an electroconductive film on the surface of a wafer to form a wiring layer by photolithography, etching etc., a step of forming an interlaminar insulating film on the wiring layer, etc., and an uneven surface made of an electroconductive material such as metal and an insulating material is generated on the surface of a wafer by these steps. In recent years, processing for fine wiring and multilayer wiring is advancing for the purpose of higher integration of semiconductor integrated circuits, and accordingly techniques of planarizing an uneven surface of a wafer have become important.

As the method of planarizing an uneven surface of a wafer, a CMP method is generally used. CMP is a technique wherein while the surface of a wafer to be polished is pressed against a polishing surface of a polishing pad, the surface of the wafer is polished with an abrasive in the form of slurry having abrasive grains dispersed therein (hereinafter, referred to as slurry). As shown in FIG. 1, a polishing apparatus used generally in CMP is provided for example with a polishing platen 2 for supporting a polishing pad 1, a supporting stand (polishing head) 5 for supporting a polished material (wafer) 4, a backing material for uniformly pressurizing a wafer, and a mechanism of feeding an abrasive. The polishing pad 1 is fitted with the polishing platen 2 for example via a double-sided tape. The polishing platen 2 and the supporting stand 5 are provided with rotating shafts 6 and 7 respectively and are arranged such that the polishing pad 1 and the polished material 4, both of which are supported by them, are opposed to each other. The supporting stand 5 is provided with a pressurizing mechanism for pushing the polished material 4 against the polishing pad 1.

When such CMP is conducted, there is a problem of judging the planarity of wafer surface. That is, the point in time when desired surface properties or planar state are reached should be detected. With respect to the thickness of an oxide film, polishing speed etc., the polishing treatment of a test wafer has been conducted by periodically treating the wafer, and after the results are confirmed, a wafer serving as a product is subjected to polishing treatment.

In this method, however, the treatment time of a test wafer and the cost for the treatment are wasteful, and a test wafer and a product wafer not subjected to processing are different in polishing results due to a loading effect unique to CMP, and accurate prediction of processing results is difficult without actual processing of the product wafer.

Accordingly, there is need in recent years for a method capable of in situ detection of the point in time when desired surface properties and thickness are attained at the time of CMP processing, in order to solve the problem described above. For such detection, various methods have been used, and from the viewpoint of measurement accuracy and spatial resolution in non-contact measurement, an optical detection means is becoming the mainstream.

The optical detection means is specifically a method of detecting the end-point of polishing by irradiating a wafer via a polishing pad through a window (light-transmitting region) with a light beam, and monitoring an interference signal generated by reflection of the light beam.

As the light beam, a white light using a halogen lamp having a light of wavelengths of 300 to 800 nm is generally used at present.

In such method, the end-point is determined by knowing an approximate depth of surface unevenness through monitoring of a change in the thickness of a surface layer of a wafer. When such change in thickness becomes equal to the thickness of the unevenness, the CMP process is finished. As a method of detecting the end-point of polishing by such optical means and a polishing pad used in the method, various methods and polishing pads have been proposed.

For example, a polishing pad having, as least a part thereof, a solid and uniform transparent polymer sheet passing a light of wavelengths of 190 nm to 3500 nm therethrough is disclosed (Patent Literature 1). Further, a polishing pad having a stepped transparent plug inserted therein is disclosed (Patent Literature 2). A polishing pad having a transparent plug on the same surface as a polishing surface is disclosed (Patent Literature 3).

Also, a polishing pad comprising a polyurethane resin not containing an aromatic polyamine and having a light transmittance of 50% or more in the overall region of wavelengths of 400 to 700 nm is disclosed (Patent Literature 4)

Further, a polishing pad having a window member having a transmittance of 30% or more in the region of wavelengths of 450 to 850 nm is disclosed (Patent Literature 5).

As described above, a white light using a halogen lamp or the like is used as the light beam, and when the white light is used, there is an advantage that the light of various wavelengths can be applied onto a wafer, and many profiles of the surface of the wafer can be obtained. When this white light is used as the light beam, detection accuracy should be increased in a broad wavelength range. However, a polishing pad having a conventional window (light-transmitting region) has a problem that the polishing pad is very poor in detection accuracy at the short-wavelength side (ultraviolet region) and causes mechanical errors in detection of the optical end-point. In high integration and micronization in production of semiconductors in the future, the wiring width of an integrated circuit is expected to be further decreased, for which highly accurate optical end-point detection is necessary, but the conventional window for end-point detection does not have sufficiently satisfactory accuracy in a broad wavelength range (particularly at the short-wavelength side).

Patent Literature 1: JP-A 11-512977
Patent Literature 2: JP-A 9-7985
Patent Literature 3: JP-A 10-83977
Patent Literature 4: JP No. 3582790
Patent Literature 5: JP-A 2003-48151

SUMMARY OF THE INVENTION

One object of the present invention is to provide a polishing pad excellent in optical detection accuracy in a broad wavelength range (particularly at the short-wavelength side). Another object of the present invention is to provide a method for manufacturing a semiconductor device which comprises a process of polishing the surface of a semiconductor wafer with the polishing pad.

In view of the existing circumstances as described above, the present inventors made intensive studies and found that the following light-transmitting region can be used as a light-transmitting region for a polishing pad to solve the problems described above.

That is, the present invention relates to a polishing pad having a polishing layer containing a polishing region and a light-transmitting region, wherein the light-transmitting region comprises a polyurethane resin having an aromatic ring density of 2 wt % or less, and the light transmittance of the light-transmitting region is 30% or more in the overall range of wavelengths of 300 to 400 nm.

As the intensity attenuation of a light passing through the light-transmitting region is decreased, the accuracy of detection of a polishing end-point and the accuracy of measurement of film thickness can be increased. Accordingly, the degree of light transmittance in the wavelength of a measurement light used is important for determining the accuracy of detection of a polishing end-point and the accuracy of measurement of film thickness. In the light-transmitting region of the present invention, the attenuation of light transmittance is low particularly at the short-wavelength side, and detection accuracy can be kept high in a broad wavelength range.

As described above, a generally used film thickness measuring instrument makes use of a laser having an oscillation wavelength in the vicinity of 300 to 800 nm so that when the light transmittance in the light-transmitting region particularly at the short-wavelength side (300 to 400 nm) is 30% or more, high reflected light can be obtained, and the accuracy of detection of an end-point and the accuracy of detection of film thickness can be significantly improved. The light transmittance at the short-wavelength side is preferably 40% or more. The light transmittance in the present invention is the transmittance of the light-transmitting region having a thickness of 1 mm or a thickness reduced to 1 mm. According to the Lambert-Beer law, the light transmittance of an object is generally changed depending on the thickness of the object. Because the light transmittance is decreased as the thickness is increased, the light transmittance of an object with its thickness fixed should be determined.

The rate of change of the light transmittance of the light-transmitting region in wavelengths of 300 to 400 nm, represented by the following equation, is preferably 70% or less.

$$\text{The rate of change (\%)} = \{(\text{maximum light transmittance at 300 to 400 nm} - \text{minimum light transmittance at 300 to 400 nm})/\text{maximum light transmittance at 300 to 400 nm}\} \times 100$$

When the rate of change of the light transmittance is higher than 70%, the intensity attenuation of a light passing the light-transmitting region at the shortest wavelength side is increased, and the oscillation of an interference light is decreased, and therefore, the accuracy of detection of a polishing end-point and the accuracy of measurement of film thickness tend to decrease. The rate of change of the light transmittance is more preferably 40% or less.

The light-transmitting region is formed from a polyurethane resin having an aromatic ring density of 2 wt % or less. By using this polyurethane resin, the light transmittance of the light-transmitting region can be regulated to be 30% or more in the overall range of wavelengths of 300 to 400 nm. The aromatic ring density refers to the weight proportion of aromatic rings in the polyurethane resin. The aromatic ring density is preferably 1 wt % or less.

The polyurethane resin is preferably a cured product obtained by reacting an aliphatic and/or alicyclic isocyanate-terminated prepolymer with a chain extender. The isocyanate component of the polyurethane resin is preferably at least one member selected from the group consisting of 1,6-hexamethylenediisocyanate, 4,4'-dicyclohexylmethanediisocyanate, and isophoronediisocyanate. The polyurethane resin containing the prepolymer or the isocyanate component is preferable as a material of the light-transmitting region because of its low aromatic ring density.

In the present invention, the material forming the light-transmitting region is preferably a non-foam. The non-foam can prevent light scattering, is thus capable of detecting accurate reflectance and capable of improving the accuracy of detection of the optical end-point of polishing.

The surface of the light-transmitting region at the polishing side does not have an uneven structure for retaining and renewing an abrasive liquid. When macroscopic surface unevenness is present on the surface of the light-transmitting region at the polishing side, a slurry containing additives such as abrasive grains may be accumulated in its concave portions to cause light scattering and absorption to exert an influence on detection accuracy. Preferably, the other surface of the light-transmitting region does not have macroscopic surface unevenness, either. This is because when macroscopic surface unevenness is present, light scattering easily occurs, which may exert an influence on detection accuracy.

In the present invention, the material for forming the polishing region is preferably a fine-cell foam.

The average cell diameter of the fine-cell foam is preferably 70 μm or less, more preferably 50 μm or less. When the average cell diameter is 70 μm or less, planarity is improved.

The specific gravity of the fine-cell foam is preferably 0.5 to 1, more preferably 0.7 to 0.9. When the specific gravity is less than 0.5, the strength of the surface of the polishing region is lowered to reduce the planarity of a polished material, while when the specific gravity is greater than 1, the number of fine cells on the surface of the polishing region is decreased, and the rate of polishing tends to be decreased even though planarity is good.

The Asker D hardness of the fine-cell foam is preferably 40 to 70 degree, more preferably 45 to 60 degree. When the Asker D hardness is less than 40 degree, the planarity of a polished material is decreased, while when the Asker D hardness is greater than 70 degree, the planarity is good, but the uniformity of a polished material tends to be decreased.

The present invention relate to a method of producing a semiconductor device, which comprises a step of polishing the surface of a semiconductor wafer with the polishing pad described above.

DETAILED DESCRIPTION OF THE INVENTION

Figure 1:
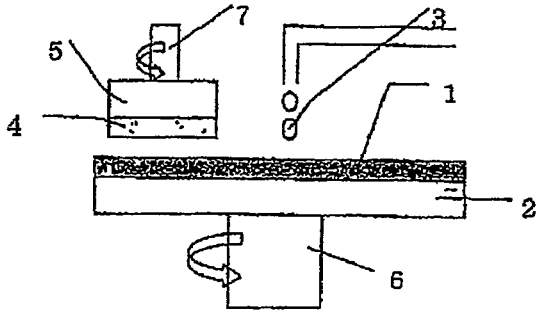
FIG. 1 is a schematic illustration showing one example of a conventional polishing apparatus used in CMP polishing.

The light-transmitting region of the present invention comprises a polyurethane resin having an aromatic ring density of 2 wt % or less, and the light transmittance of the light-transmitting region is 30% or more in the overall range of wavelengths of 300 to 400 nm.

The polyurethane resin is a preferable material because it is highly abrasion-resistant and capable of suppressing the light scattering in the light-transmitting region caused by dressing trace during polishing.

The polyurethane resin is constituted of an isocyanate component, a polyol component (a high-molecular-weight polyol and a low-molecular-weight polyol) and a chain extender.

As the isocyanate component, a compound known in the field of polyurethane can be used without particular limitation. The isocyanate component includes, for example, aromatic diisocyanates such as 2,4-toluene diisocyanate, 2,6-toluene diisocyanate, 2,2'-diphenyl methane diisocyanate, 2,4'-diphenyl methane diisocyanate, 4,4'-diphenyl methane diisocyanate, 1,5-naphthalene diisocyanate, p-phenylene diisocyanate, m-phenylene diisocyanate, p-xylylene diisocyanate and m-xylylene diisocyanate, aliphatic diisocyanates such as ethylene diisocyanate, 2,2,4-trimethyl hexamethylene diisocyanate and 1,6-hexamethylene diisocyanate, and alicyclic diisocyanates such as 1,4-cyclohexane diisocyanate, 4,4'-dicyclohexyl methane diisocyanate, isophorone diisocyanate and norbornane diisocyanate. These may be used alone or as a mixture of two or more thereof. Among these components, aliphatic diisocyanates and/or alicyclic diisocyanates are preferably used to adjust to 2 wt % or less of the density of aromatic rings, and particularly, at least one diisocyanate selected from the group consisting of 1,6-hexamethylene diisocyanate, 4,4'-dicyclohexylmethane diisocyanate, and isophorone diisocyanate is preferably used.

As the high-molecular-weight polyol, a compound known in the field of polyurethane can be used without particular limitation. The high-molecular-weight polyol includes, for example, polyether polyols represented by polytetramethylene ether glycol and polyethylene glycol, polyester polyols represented by polybutylene adipate, polyester polycarbonate polyols exemplified by reaction products of polyester glycols such as polycaprolactone polyol and polycaprolactone with alkylene carbonate, polyester polycarbonate polyols obtained by reacting ethylene carbonate with a multivalent alcohol and reacting the resulting reaction mixture with an organic dicarboxylic acid, and polycarbonate polyols obtained by ester exchange reaction of a polyhydroxyl compound with aryl carbonate. These may be used singly or as a mixture of two or more thereof. Among these, high-molecular-weight polyols not having an aromatic ring are preferably used to adjust to 2 wt % or less of the density of aromatic rings. For improving light transmittance, high-molecular-weight polyols not having a long resonance structure or high-molecular-weight polyols not having so much skeleton structure having high electron-withdrawing and electron-donating properties are preferably used.

Examples of the low-molecular-weight polyol that can be used together with a high-molecular-weight polyol described above include: ethylene glycol, 1,2-propylene glycol, 1,3-propylene glycol, 1,4-butanediol, 1,6-hexanediol, neopentyl glycol, 1,4-cyclohexanedimethanol, 3-methyl-1,5-pentanediol, diethylene glycol, triethyleneglycol and the like. Other examples that can be used together with the high-molecular-weight polyol also include: low-molecular-weight polyamine such as ethylenediamine, diethylenetriamine and the like. To adjust to 2 wt % or less of the density of aromatic rings, low-molecular-weight polyols not having an aromatic ring or low-molecular-weight polyamines not having an aromatic ring are preferably used.

Concrete examples of the chain extender include: aromatic polyamines such as 4,4'-methylenebis(o-chloroaniline) (MOCA), 2,6-dichloro-p-phenylenediamine, 4,4'-methylenebis(2,3-dichloroaniline), 3,5-bis(methylthio)-2,4-toluenediamine, 3,5-bis(methylthio)-2,6-toluenediamine, 3,5-diethyltoluene-2,4-diamine, 3,5-diethyltoluene-2,6-diamine, trimethylene glycol-di-p-aminobenzoate, 1,2-bis(2-aminophenylthio) ethane, 4,4'-diamino-3,3'-diethyl-5,5'-dimethyldiphenylmethane, N,N'-di-sec-butyl-4,4'-diaminophenylmethane, 3,3'-diethyl-4,4'-diaminodiphenylmethane, m-xylylenediamine, N,N'-di-sec-butyl-p-phenylenediamine, m-phenylenediamine and p-xylylenediamine; low-molecular-weight polyols; and low-molecular-weight polyamines. The chain extenders described above may be used either alone or in mixture of two kinds or more. In order to adjust to 2 wt % or less of the density of aromatic rings in the polyurethane resin, however, the aromatic polyamines are preferably not used, but may be incorporated in such a range that the light transmission characteristics are not deteriorated.

The proportion of the isocyanate component, the polyol component and the chain extender in the polyurethane resin can be changed suitably depending on their respective molecular weights, desired physical properties of the light-transmitting region produced therefrom, etc.

The polyurethane resin can be polymerized by known urethane-making techniques such as a melting method, a solution method etc., but in consideration of cost and working atmosphere, the polyurethane resin is formed preferably by the melting method.

The polyurethane resin can be produced by a prepolymer method or a one-shot method, but the prepolymer method wherein an isocyanate-terminated prepolymer synthesized previously from an isocyanate component and a polyol component is reacted with a chain extender is preferably used.

The method of preparing the light-transmitting region is not particularly limited, and the light-transmitting region can be prepared according to methods known in the art. For example, a method wherein a block of polyurethane resin produced by the method described above is cut in a predetermined thickness by a slicer in a handsaw system or a planing system, a method that involves casting resin into a mold having a cavity of predetermined thickness and then curing the resin, a method of using coating techniques and sheet molding techniques, etc. are used. When there are bubbles in the light-transmitting region, the decay of reflected light becomes significant due to light scattering, thus reducing the accuracy of detection of polishing endpoint and the accuracy of measurement of film thickness. Accordingly, gas contained in the material before mixing is sufficiently removed under reduced pressure at 10 Torr or less. In the case of a usually used stirring blade mixer, the mixture is stirred at a revolution number of 100 rpm or less so as not to permit bubbles to be incorporated into it in the stirring step after mixing. The stirring step is also preferably conducted under reduced pressure. When a rotating mixer is used, bubbles are hardly mixed even in high rotation, and thus a method of stirring and defoaming by using this mixer is also preferable.

The shape and size of the light-transmitting region are not particularly limited, but are preferably similar to the shape and size of the opening of the polishing region.

The thickness of the light-transmitting region is preferably equal to or less than that of the polishing region. When the light-transmitting region is thicker than the polishing region, a wafer may be damaged by a protruded portion during polishing. On the other hand, when the light-transmitting region is too thin, durability becomes insufficient. The abradability of the light-transmitting region is preferably equal to or less than that of the polishing region. When the light-transmitting region is less abraded than the polishing region, a wafer may be damaged by a protruded portion during polishing.

The material for forming the polishing region can be used without particular limitation insofar as it is usually used as the material of a polishing layer, but in the present invention, fine-cell foam is preferably used. When the fine-cell foam is used, slurry can be retained on cells of the surface to increase the rate of polishing.

The material for forming the polishing region includes, for example, polyurethane resin, polyester resin, polyamide resin, acrylic resin, polycarbonate resin, halogenated resin (polyvinyl chloride, polytetrafluoroethylene, polyvinylidene fluoride etc.), polystyrene, olefinic resin (polyethylene, polypropylene etc.), epoxy resin, and photosensitive resin. These may be used alone or as a mixture of two or more thereof.

The polyurethane resin is a particularly preferable material because it is excellent in abrasion resistance and a polyurethane polymer having desired physical properties can be easily obtained by changing its raw material composition. The starting materials of the polyurethane resin are the same as described above.

A number-average molecular weight of a high-molecular-weight polyol is preferably in the range of from 500 to 2000, more preferably in the range of from 500 to 1000 from the viewpoint of an elastic characteristic of an obtained polyurethane resin. If a number-average molecular weight thereof is less than 500, a polyurethane resin obtained by using the polyol does not have a sufficient elastic characteristic and easy to be fragile, and a polishing pad made from the polyurethane resin is excessively hard, which sometimes causes scratches to be generated on a surface of an object to be polished. Moreover, since a polishing pad is easy to be worn away, it is unpreferable from the viewpoint of a life of a polishing pad. On the other hand, if a number-average molecular weight thereof exceeds 2000, a polishing pad made from a polyurethane resin obtained from such a polyol is unpreferably soft to thereby disable a sufficiently satisfiable planarity to be earned.

The polyurethane resin can be produced by the same method as described above.

The method of finely foaming the polyurethane resin includes, but is not limited to, a method of adding hollow beads and a method of forming foam by mechanical foaming, chemical foaming etc. These methods can be simultaneously used, but the mechanical foaming method using an active hydrogen group-free silicone-based surfactant consisting of a polyalkyl siloxane/polyether copolymer is more preferable. As the silicone-based surfactant, SH-192 and L-5340 (Toray Dow Corning Silicone Co., Ltd.) can be mentioned as a preferable compound.

Description will be given of an example of a method of producing a polyurethane foam of a fine cell type constituting a polishing region below. A method of manufacturing such a polyurethane foam has the following steps:

1) a foaming step of preparing a bubble dispersion liquid of an isocyanate-terminated prepolymer, wherein a silicone-based surfactant is added into an isocyanate-terminated prepolymer, which is agitated in the presence of a non-reactive gas to thereby disperse the non-reactive gas into the prepolymer as fine bubbles and obtain a bubble dispersion liquid. In a case where the prepolymer is solid at an ordinary temperature, the prepolymer is preheated to a proper temperature and used in a molten state.
2) a curing agent (chain extender) mixing step, , wherein a chain extender is added into the bubble dispersion liquid, which is agitated to thereby obtain a foaming reaction liquid.
3) a casting step, , wherein the forming reaction liquid is cast into a mold.
4) a curing step, , wherein the foaming reaction liquid having been cast into the mold is heated and reaction-cured.

The inert gas used for forming fine cells is preferably not combustible, and is specifically nitrogen, oxygen, a carbon dioxide gas, a rare gas such as helium and argon, and a mixed gas thereof, and the air dried to remove water is most preferable in respect of cost.

As a stirrer for dispersing the silicone-based surfactant-containing isocyanate-terminated prepolymer to form fine cells with the inert gas, known stirrers can be used without particular limitation, and examples thereof include a homogenizer, a dissolver, a twin-screw planetary mixer etc. The shape of a stirring blade of the stirrer is not particularly limited either, but a whipper-type stirring blade is preferably used to form fine cells.

In a preferable mode, different stirrers are used in stirring for forming a cell dispersion in the stirring step and in stirring for mixing an added chain extender in the mixing step, respectively. In particular, stirring in the mixing step may not be stirring for forming cells, and a stirrer not generating large cells is preferably used. Such a stirrer is preferably a planetary mixer. The same stirrer may be used in the stirring step and the mixing step, and stirring conditions such as revolution rate of the stirring blade are preferably regulated as necessary.

In the method of producing the polyurethane foam, heating and post-curing of the foam obtained after casting and reacting the forming reaction liquid in a mold until the dispersion lost fluidity are effective in improving the physical properties of the foam, and are extremely preferable. The forming reaction liquid may be cast in a mold and immediately post-cured in a heating oven, and even under such conditions, heat is not immediately conducted to the reactive components, and thus the diameters of cells are not increased. The curing reaction is conducted preferably at normal pressures to stabilize the shape of cells.

In the production of the polyurethane resin, a known catalyst promoting polyurethane reaction, such as tertiary amine- or organotin-based catalysts, may be used. The type and amount of the catalyst added are determined in consideration of flow time in casting in a predetermined mold after the mixing step.

Production of the polyurethane foam may be in a batch system where each component is weighed out, introduced into a vessel and mixed or in a continuous production system where each component and an inert gas are continuously supplied to, and stirred in, a stirring apparatus and the resulting cell dispersion is transferred to produce molded articles.

The polishing region is produced by cutting the above prepared polyurethane foam into a piece of predetermined size.

The polishing region consisting of fine-cell foam is preferably provided with grooves for retaining and renewing slurry on the surface of the polishing pad which contacts with a polished material. The polishing region composed of fine-cell foam has many openings to retain slurry, and for further efficient retention and renewal of slurry and for preventing the destruction of a polished material by adsorption, the polishing region preferably has grooves on the surface thereof in the polishing side. The shape of the grooves is not particularly limited insofar as slurry can be retained and renewed, and examples include latticed grooves, concentric circle-shaped grooves, through-holes, non-through-holes, polygonal prism, cylinder, spiral grooves, eccentric grooves, radial grooves, and a combination of these grooves. The groove pitch, groove width, groove thickness etc. are not particularly limited either, and are suitably determined to form grooves. These grooves are generally those having regularity, but the groove pitch, groove width, groove depth etc. can also be changed at each certain region to make retention and renewal of slurry desirable.

The method of forming grooves is not particularly limited, and for example, formation of grooves by mechanical cutting with a jig such as a bite of predetermined size, formation by casting and curing resin in a mold having a specific surface shape, formation by pressing resin with a pressing plate having a specific surface shape, formation by photolithography, formation by a printing means, and formation by a laser light using a $CO_2$ gas laser or the like.

Although the thickness of the polishing region is not particularly limited, the thickness is about 0.8 to 4 mm, preferably 1 to 2 mm. The method of preparing the polishing region of this thickness includes a method wherein a block of the polyurethane foam is cut in predetermined thickness by a slicer in a bandsaw system or a planing system, a method that involves casting resin into a mold having a cavity of predetermined thickness and curing the resin, a method of using coating techniques and sheet molding techniques, etc.

The method for manufacturing the polishing pad having a polishing layer containing a polishing region and a light-transmitting region is not particularly limited, and various methods are conceivable. Hereinafter, examples of such methods are described. In the following examples, the polishing pad provided with a cushion layer is described, but the polishing pad may not be provided with a cushion layer.

Figure 2:
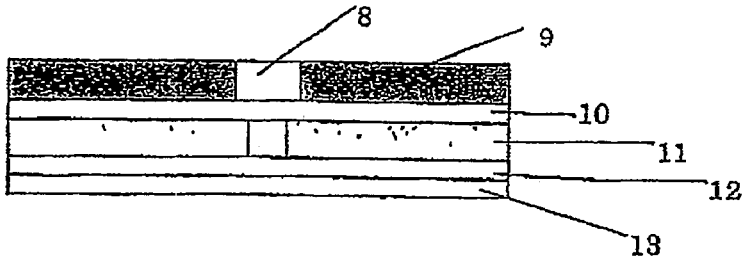
FIG. 2 is a schematic sectional view showing one example of the polishing pad of the present invention.

In a first example, as shown in FIG. 2, a polishing region 9 having an opening of specific size is stuck on a double-sided tape 10, and then a cushion layer 11 having an opening of specific size is stuck thereon such that its opening is in the same position as the opening of the polishing region 9. Then, a double-sided tape 12 provided with a release paper 13 is stuck on the cushion layer 11, and a light-transmitting region 8 is inserted into, and stuck on, the opening of the polishing region 9.

Figure 3:
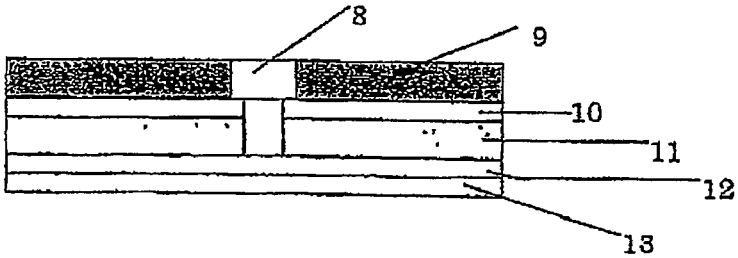
FIG. 3 is a schematic sectional view showing another example of the polishing pad of the present invention.

In a second example, as shown in FIG. 3, a polishing region 9 having an opening of specific size is stuck on a double-sided tape 10, and then a cushion layer 11 is stuck thereon. Thereafter, the double-sided tape 10 and the cushion layer 11 are provided with an opening of specific size so as to be fitted to the opening of the polishing region 9. Then, a double-sided tape 12 provided with a release paper 13 is stuck on the cushion layer 11, and a light-transmitting region 8 is inserted into, and stuck on, the opening of the polishing region 9.

Figure 4:
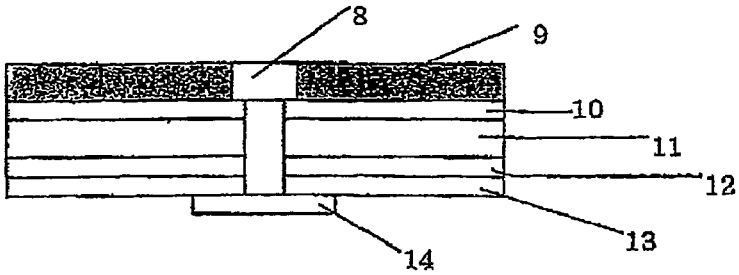
FIG. 4 is a schematic sectional view showing another example of the polishing pad of the present invention.

In a third example, as shown in FIG. 4, a polishing region 9 having an opening of specific size is stuck on a double-sided tape 10, and then a cushion layer 11 is stuck thereon. Then, a double-sided tape 12 provided with a release paper 13 is stuck on the other side of the cushion layer 11, and thereafter, an opening of predetermined size to be fitted to the opening of the polishing region 9 is produced from the double-sided tape 10 to the release paper 13. A light-transmitting region 8 is inserted into, and stuck on, the opening of the polishing region 9. In this case, the opposite side of the light-transmitting region 8 is open so that dust etc. may be accumulated, and thus a member 14 for closing it is preferably attached.

Figure 5:
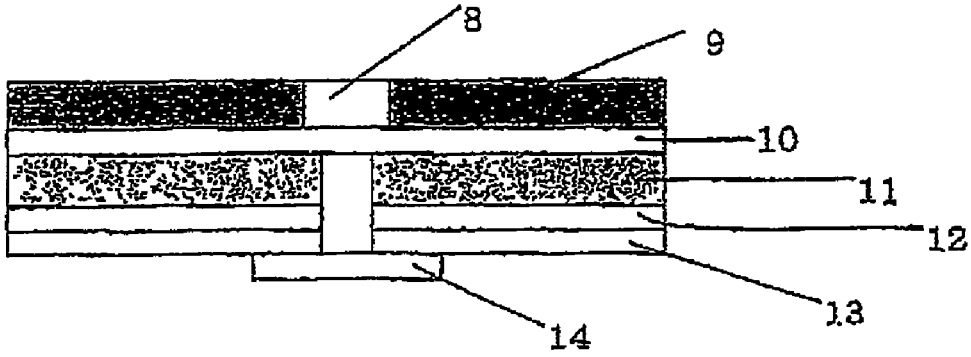
FIG. 5 is a schematic sectional view showing another example of the polishing pad of the present invention.
Figure 6:
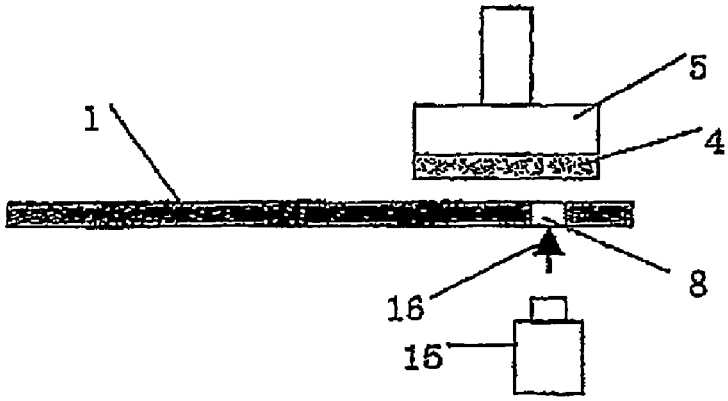
FIG. 6 is a schematic illustration showing one example of a CMP polishing apparatus having the end-point detection device of the present invention.

In a fourth example, as shown in FIG. 5, a cushion layer 11 having a double-sided tape 12 provided with a release paper 13 is provided with an opening of predetermined size. Then, a polishing region 9 having an opening of predetermined size is stuck on a double-sided tape 10 which is then stuck on the cushion layer 11 such that their openings are positioned in the same place. Then, a light-transmitting region 8 is inserted into, and stuck on, the opening of the polishing region 9. In this case, the opposite side of the polishing region is open so that dust etc. may be accumulated, and thus a member 14 for closing it is preferably attached.

In the method of preparing the polishing pad, the means of forming an opening in the polishing region and the cushion layer is not particularly limited, but for example, a method of opening by pressing with a jig having a cutting ability, a method of utilizing a laser such as a $CO_2$ laser, and a method of cutting with a jig such as a bite. The size and shape of the opening of the polishing region are not particularly limited.

The cushion layer compensates for characteristics of the polishing region (polishing layer). The cushion layer is required for satisfying both planarity and uniformity which are in a tradeoff relationship in chemical mechanical polishing (CMP). Planarity refers to flatness of a pattern region upon polishing an object of polishing having fine unevenness generated upon pattern formation, and uniformity refers to the uniformity of the whole of an object of polishing. Planarity is improved by the characteristics of the polishing layer, while uniformity is improved by the characteristics of the cushion layer. The cushion layer used in the polishing pad of the present invention is preferably softer than the polishing layer.

The material forming the cushion layer is not particularly limited, and examples of such material include a nonwoven fabric such as a polyester nonwoven fabric, a nylon nonwoven fabric or an acrylic nonwoven fabric, a nonwoven fabric impregnated with resin such as a polyester nonwoven fabric impregnated with polyurethane, polymer resin foam such as polyurethane foam and polyethylene foam, rubber resin such as butadiene rubber and isoprene rubber, and photosensitive resin.

The means of sticking the polishing layer used in the polishing region 9 on the cushion layer 11 includes, for example, a method of pressing the polishing region and the cushion layer having a double-sided tape therebetween.

The double-sided tape has a general constitution wherein an adhesive layer is arranged on both sides of a base material such as a nonwoven fabric or a film. In consideration of permeation of slurry into the cushion layer, a film is preferably used as the base material. The composition of the adhesive layer includes, for example, a rubber-based adhesive and an acrylic adhesive. In consideration of the content of metallic ion, the acrylic adhesive is preferable because of a lower content of metallic ion. Because the polishing region and the cushion layer can be different in composition, the composition of each adhesive layer of the double-sided tape can be different to make the adhesion of each layer suitable.

The means of sticking the cushion layer 11 on the double-sided tape 12 includes a method of sticking the double-sided tape by pressing on the cushion layer.

As described above, the double-sided tape has a general constitution wherein an adhesive layer is arranged on both sides of a base material such as a nonwoven fabric or a film.

In consideration of removal of the polishing pad after use from a platen, a film is preferably used as the base material in order to solve a residual tape. The composition of the adhesive layer is the same as described above.

The member 14 is not particularly limited insofar as the opening is closed therewith. When polishing is conducted, it should be releasable.

The semiconductor device is produced by a step of polishing the surface of a semiconductor wafer by using the polishing pad. The semiconductor wafer generally comprises a wiring metal and an oxide film laminated on a silicon wafer. The method of polishing a semiconductor wafer and a polishing apparatus are not particularly limited, and as shown in FIG. 1, polishing is conducted for example by using a polishing apparatus including a polishing platen 2 for supporting a polishing pad 1, a supporting stand (polishing head) 5 for supporting a semiconductor wafer 4, a backing material for uniformly pressurizing the wafer, and a mechanism of feeding an abrasive 3. The polishing pad 1 is fitted, for example via a double-coated tape, with the polishing platen 2. The polishing platen 2 and the supporting stand 5 are provided with rotating shafts 6 and 7 and arranged such that the polishing pad 1 and the semiconductor wafer 4, both of which are supported by them, are arranged to be opposite to each other. The supporting stand 5 is provided with a pressurizing mechanism for pushing the semiconductor wafer 4 against the polishing pad 1. For polishing, the polishing platen 2 and the supporting stand 5 are rotated and simultaneously the semiconductor wafer 4 is polished by pushing it against the polishing pad 1 with slurry fed thereto. The flow rate of slurry, polishing loading, number of revolutions of the polishing platen, and number of revolutions of the wafer are not particularly limited and can be suitably regulated.

Protrusions on the surface of the semiconductor wafer 4 are thereby removed and polished flatly. Thereafter, a semiconductor device is produced therefrom through dicing, bonding, packaging etc. The semiconductor device is used in an arithmetic processor, a memory etc.

EXAMPLES

Hereinafter, the Examples illustrating the constitution and effect of the invention are described. Evaluation items in the Examples etc. were measured in the following manner.

(Measurement of Light Transmittance)

The prepared light-transmitting region was cut out in a size of 10 mm×50 mm (thickness: 1.25 mm) to prepare a sample for measurement of light transmittance. The sample was placed in a glass cell filled with extra-pure water (optical path length 10 mm×optical path width 10 mm×height 45 mm, manufactured by SOGO LABORATORY GLASS WORKS CO., LTD.) and measured in the measurement wavelength range of 300 to 400 nm with a spectrophotometer (UV-1600PC, manufactured by Shimadzu Corporation). In the measurement result of light transmittance, light transmittance per mm thickness was expressed by using the Lambert-Beer law. Light transmittances at 300 nm and 400 nm, and the maximum and minimum light transmittances in the measurement wavelength range of 300 to 400 nm, are shown in Table 3.

(Measurement of Average Cell Diameter)

A polishing region cut parallel to be as thin as about 1 mm by a microtome cutter was used as a sample for measurement of average cell diameter. The sample was fixed on a slide glass, and the diameters of all cells in an arbitrary region of 0.2 mm×0.2 mm were determined by an image processor (Image Analyzer V10, manufactured by Toyobouseki Co., Ltd), to calculate the average cell diameter.

(Measurement of Specific Gravity)

Determined according to JIS Z8807-1976. A polishing region cut out in the form of a strip of 4 cm×8.5 cm (thickness: arbitrary) was used as a sample for measurement of specific gravity and left for 16 hours in an environment of a temperature of 23±2° C. and a humidity of 50%±5%. Measurement was conducted by using a specific gravity hydrometer (manufactured by Sartorius Co., Ltd).

(Measurement of Asker D Hardness)

Measurement is conducted according to JIS K6253-1997. A polishing region cut out in a size of 2 cm×2 cm (thickness: arbitrary) was used as a sample for measurement of hardness and left for 16 hours in an environment of a temperature of 23±2° C. and a humidity of 50%±5%. At the time of measurement, samples were stuck on one another to a thickness of 6 mm or more. A hardness meter (Asker D hardness meter, manufactured by Kobunshi Keiki Co., Ltd.) was used to measure hardness.

(Evaluation of Film Thickness Detection)

The evaluation of optical detection of film thickness of a wafer was conducted in the following manner. As a wafer, a 1 μm thermal-oxide film was deposited on an 8-inch silicone wafer, and a light-transmitting region member of 1.27 mm in thickness was arranged thereon. The film thickness was measured several times in the wavelength range of 300 to 400 nm by using an interference film thickness measuring instrument (manufactured by Otsuka Electronics Co., Ltd). The result of calculated film thickness and the state of top and bottom of interference light at each wavelength were confirmed, and the film thickness detection was evaluated under the following criteria:

⊙: Film thickness is measured with very good reproducibility.

o: Film thickness is measured with good reproducibility.

x: Detection accuracy is insufficient with poor reproducibility.

Example 1

[Preparation of Light-transmitting Region]

625 parts by weight of hexamethylenediisocyanate, 242 parts by weight of polytetramethylene ether glycol having a number-average molecular weight of 650 and 134 parts by weight of 1,3-butanediol were introduced into a container and heated at 80° C. for 2 hours under stirring to give an isocyanate-terminated prepolymer A. Then, 6 parts by weight of 1,3-butanediol, 10 parts by weight of trimethylol propane and 0.35 part by weight of an amine catalyst (Kao No. 25, manufactured by Kao Corporation) were mixed to prepare a liquid mixture, and 100 parts by weight of the isocyanate-terminated prepolymer A was added to the liquid mixture, then sufficiently stirred with a hybrid mixer (manufactured by Keyence Corporation) and defoamed to give a composition for forming a light-transmitting region. Thereafter, the composition for forming a light-transmitting region was dropped on a mold previously subjected to release treatment, then covered with a PET film previously subjected to release treatment, and regulated to be 1.25 mm in thickness with a nip roll. Thereafter, the mold was placed in an oven and cured at 100° C. for 16 hours to give a polyurethane resin sheet. The polyurethane resin sheet was punched out with a Thomson blade to prepare a light-transmitting region (57 mm×19 mm, thickness 1.25 mm).

[Preparation of Polishing Region]

100 parts by weight of a polyether-based prepolymer (Adiprene L-325, NCO content of 2.22 meq/g, manufactured by Uniroyal Chemical) and 3 parts by weight of a silicone-based surfactant (SH192 manufactured by Toray Dow Corning Silicone Co., Ltd.) were introduced into a reaction container, and the temperature was regulated at 80° C. The mixture was stirred vigorously for about 4 minutes at a revolution number of 900 rpm by a stirring blade to incorporate bubbles into the reaction system. 26 parts by weight of filtered 4,4'-methylene bis(o-chloroaniline) previously melted at 120° C. (IHARA CUAMINE MT manufactured by Ihara Chemical Industry Co., Ltd.) were added thereto. Thereafter, the reaction solution was stirred for about 1 minute and poured into a pan-type open mold. When the fluidity of this reaction solution was lost, the reaction solution was introduced into an oven and post-cured at 110° C. for 6 hours to give a polyurethane foam block. This polyurethane foam block was sliced by a band-saw-type slicer (manufactured by Fecken) to give a polyurethane foam sheet. Then, this sheet was surface-buffed to predetermined thickness by a buffing machine (manufactured by Amitec) to give a sheet having regulated thickness accuracy (sheet thickness, 1.27 mm). This buffed sheet was cut into a round sheet having a predetermined diameter (61 cm) and provided with grooves in the form of concentric circles having a groove width of 0.25 mm, a groove pitch of 1.50 mm and a groove depth of 0.40 mm by using a grooving machine (manufactured by TohoKoki Co., Ltd.). A double-coated tape (Double Tack Tape, manufactured by Sekisui Chemical Co., Ltd.) was stuck by a laminator on the other side than the grooved surface of this sheet, and thereafter, a hole (57.5 mm×19.5 mm) for inserting a light-transmitting region into a predetermined position of the grooved sheet was punched out, to prepare a polishing region provided with the double-coated tape. Physical properties of the prepared polishing region were as follows: average cell diameter, 48 μm; specific gravity, 0.86; Asker D hardness, 53 degree.

[Preparation of Polishing Pad]

A cushion layer consisting of polyethylene foam (Toray Pef, thickness of 0.8 mm, manufactured by Toray Industries, Inc.) having a surface brushed with a buff and subjected to corona treatment was stuck by a laminator on the pressure-sensitive adhesive surface of a double-coated tape provided with the polishing region. Further, the double-coated tape was stuck on the surface of the cushion layer. Thereafter, the cushion layer was punched out with a size of 51 mm×13 mm in the punched hole of the polishing region for inserting a light-transmitting region, to penetrate the hole. Thereafter, the light-transmitting region prepared was inserted into the hole to prepare a polishing pad.

Examples 2 to 7 and Comparative Example 1

Light-transmitting regions were prepared with the compounding ratios in Tables 1 and 2 in the same manner as in Example 1. The light-transmitting regions were used to prepare polishing pads in the same manner as in Example 1. Table 1 shows compounding ratios of the isocyanate-terminated prepolymers as the starting material of the light-transmitting region. Table 2 shows compounding ratios of the light-transmitting region-forming compositions. The compounds shown in Tables 1 and 2 are as follows.

PTMG-650: polytetramethylene ether glycol having a number-average molecular weight of 650

PTMG-1000: polytetramethylene ether glycol having a number-average molecular weight of 1000

1,3-BG: 1,3-butanediol 1,4-BG: 1,4-butanediol

DEG: diethylene glycol

TMP: trimethylol propane

HDI: 1,6-hexamethylenediisocyanate

HMDI: 4,4'-dicyclohexylmethanediisocyanate

IPDI: isophoronediisocyanate

TDI: toluene diisocyanate

Ethacure 100 (manufactured by Albemarle): mixture of 3,5-diethyl-2,4-toluenediamine and 3,5-diethyl-2,6-toluenediamine MOCA: 4,4'-methylene bis(o-chloroaniline)

TABLE 1

| | | Example 1 | Example 2 | Example 3 | Example 4 | Example 5 | Example 6 | Example 7 | Comparative Example 1 |
|---|---|---|---|---|---|---|---|---|---|
| Polyol | PTMG-650 | 242 | | 242 | 252 | | | 279 | |
| | PTMG-1000 | | | | | 462 | 462 | | 528 |
| | 1,3-BG | 134 | 230 | | 81 | | | 90 | |
| | 1,4-BG | | | 134 | | | | | |
| | DEG | | | | | 54 | 54 | | 55 |
| Isocyanate | HDI | 625 | 770 | 625 | | | | | |
| | HMDI | | | | 667 | 484 | 484 | | 76 |
| | IPDI | | | | | | | 631 | |
| | TDI | | | | | | | | 341 |

TABLE 2

| | | Example 1 | Example 2 | Example 3 | Example 4 | Example 5 | Example 6 | Example 7 | Comparative Example 1 |
|---|---|---|---|---|---|---|---|---|---|
| Isocyanate-terminated prepolymer | | 100 | 100 | 100 | 100 | 100 | 100 | 100 | 100 |
| Chain extender | 1,3-BG | 6 | | | 3 | | | 7 | |
| | TMP | 10 | 13 | 10 | 7 | 5 | | 5 | |
| | 1,4-BG | | | 6 | | | 5 | | |
| | PTMG-650 | | 29 | | | | | | |

TABLE 2-continued

| | | Example 1 | Example 2 | Example 3 | Example 4 | Example 5 | Example 6 | Example 7 | Comparative Example 1 |
|---|---|---|---|---|---|---|---|---|---|
| | Ethacure 100 | | | | | 5 | 5 | | |
| | MOCA | | | | | | | | 29 |
| Amine catalyst | Kao No. 25 | 0.35 | 0.43 | 0.35 | 0.33 | | | 0.34 | |
| Aromatic ring density (wt %) | | 0 | 0 | 0 | 0 | 1.8 | 1.8 | 0 | 23.1 |

TABLE 3

| | Light transmittance (%) | | Maximum light | Minimum light | Rate of | Detection of film |
|---|---|---|---|---|---|---|
| | 300 nm | 400 nm | transmittance (%) | transmittance (%) | change (%) | thickness |
| Example 1 | 65.8 | 93.2 | 93.2 | 65.8 | 29.4 | ⊙ |
| Example 2 | 72.6 | 95.6 | 96.0 | 72.6 | 24.4 | ⊙ |
| Example 3 | 67.4 | 91.6 | 91.8 | 67.4 | 26.6 | ⊙ |
| Example 4 | 62.9 | 93.7 | 93.7 | 62.9 | 32.9 | ⊙ |
| Example 5 | 40.6 | 92.1 | 92.1 | 40.6 | 55.9 | ○ |
| Example 6 | 35.6 | 94.6 | 94.6 | 35.6 | 62.4 | ○ |
| Example 7 | 63.7 | 91.9 | 92.1 | 63.7 | 30.8 | ⊙ |
| Comparative Example 1 | 0 | 76.2 | 76.2 | 0 | 100 | X |

As can be seen from Table 3, the light-transmitting regions having a transmittance of 30% or more at wavelengths of 300 to 400 nm can be used to detect the end-point of a wafer with good reproducibility.

The invention claimed is:

1. A polishing pad having a polishing layer containing a polishing region and a light-transmitting region, wherein the light-transmitting region comprises a polyurethane resin having an aromatic ring density of 2 wt % or less, and the light transmittance of the light-transmitting region is 30% or more in the overall range of wavelengths of 300 to 400 nm.

2. The polishing pad according to claim 1, wherein the rate of change of the light transmittance of the light-transmitting region in wavelengths of 300 to 400 nm, represented by the following equation, is 70% or less:

the rate of change (%)={(maximum light transmittance at 300 to 400 nm−minimum light transmittance at 300 to 400 nm)/maximum light transmittance at 300 to 400 nm}×100.

3. The polishing pad according to claim 1, wherein the polyurethane resin is a cured product obtained by reacting an aliphatic and/or alicyclic isocyanate-terminated prepolymer with a chain extender.

4. The polishing pad according to claim 1, wherein the isocyanate component of the polyurethane resin is at least one member selected from the group consisting of 1, 6-hexamethylenediisocyanate, 4,4'-dicyclohexylmethanediisocyanate, and isophoronediisocyanate.

5. A method for manufacturing a semiconductor device, which comprises a process of polishing the surface of a semiconductor wafer with the polishing pad according to claim 1, 2, 3, or 4.

* * * * *